US008282144B1

(12) United States Patent
George et al.

(10) Patent No.: US 8,282,144 B1
(45) Date of Patent: Oct. 9, 2012

(54) LIFTING RING ASSEMBLY

(75) Inventors: David K. George, Colleyville, TX (US); Scott T. Page, Keller, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 439 days.

(21) Appl. No.: 12/506,758

(22) Filed: Jul. 21, 2009

Related U.S. Application Data

(60) Provisional application No. 61/085,009, filed on Jul. 31, 2008.

(51) Int. Cl.
*B66C 1/10* (2006.01)

(52) U.S. Cl. ..... 294/215; 294/89

(58) Field of Classification Search ..... 294/1.1, 294/215, 89, 82.1, 81.5, 81.6, 81.61, 68.1; 403/78, 79, 119, 164, 165; 411/100; 248/199; 52/125.5

See application file for complete search history.

(56) References Cited

U.S. PATENT DOCUMENTS

| | | | | | |
|---|---|---|---|---|---|
| 1,144,415 | A * | 6/1915 | Jones | 294/82.19 |
| 1,650,038 | A * | 11/1927 | Potter | 294/82.19 |
| 1,727,685 | A * | 9/1929 | Willoughby | 220/1.5 |
| 1,733,509 | A * | 10/1929 | Minor et al. | 294/82.17 |
| 2,215,049 | A * | 9/1940 | Minor | 294/82.16 |
| 5,490,702 | A * | 2/1996 | Fleming | 294/97 |
| 6,039,500 | A * | 3/2000 | Kwon | 403/78 |
| 7,114,872 | B2 * | 10/2006 | Alba | 403/78 |
| 7,625,024 | B2 * | 12/2009 | Wright et al. | 294/215 |
| 2010/0117386 | A1 * | 5/2010 | Ying | 294/1.1 |

* cited by examiner

*Primary Examiner* — Paul T Chin
(74) *Attorney, Agent, or Firm* — Slater & Matsil, L.L.P.

(57) ABSTRACT

A lifting ring assembly includes a shackle plate, a shackle operably associated with the shackle plate, and a lifting ring operably associated with the shackle. The lifting ring assembly further includes a biasing element operably associated with the shackle plate and the lifting ring for biasing the lifting ring away from the shackle plate.

12 Claims, 4 Drawing Sheets

LIFTING RING ASSEMBLY

CROSS-REFERENCE TO RELATED APPLICATIONS

This application claims the benefit of U.S. Provisional Application No. 61/085,009, filed 31 Jul. 2008, and entitled "Lifting Ring Assembly," which is hereby expressly incorporated by reference for all purposes.

BACKGROUND

1. Field of the Invention

The present invention relates to material handling devices.

2. Description of Related Art

As will be appreciated by those familiar with the art, shackles and lifting rings are commonly used, often with shackle plates, in the lifting of heavy objects with a crane, hoist, or other such lifting equipment. FIG. 1 depicts a conventional configuration, in which a shackle 101 is coupled with a shackle plate 103. A lifting ring 105 is disposed within an eye of shackle 101. Shackle plate 103 is shown attached to a structure 107. When in use, as shown in FIG. 1, a hook 109 is coupled with lifting ring 105. As hook 109 is raised, as indicated by an arrow 111, it is desirable for shackle 101 and lifting ring 105 to generally aligned in the lifting direction.

Often times, however, lifting ring 105 becomes caught on adjacent protrusions and the like, causing lifting ring 105 to become kinked and yielding an unsafe and undesirable situation. For example, as shown in FIG. 2, lifting ring 105 has become kinked with respect to shackle 101 causing shackle to be rotated away from being aligned with the lifting direction as hook 109 is raised. Firstly, shackle 101 and lifting ring 105 are not designed to be used in the illustrated configuration. Accordingly, either or both of shackle 101 and lifting ring 105 may mechanically fail, depending upon the mechanical load being carried by shackle 101 and lifting ring 105. Moreover, as hook 109 is further raised, lifting ring 105 may abruptly become unkinked, causing a mechanical shock to be transmitted to the load being carried by shackle 101 and lifting ring 105. Such a mechanical shock may cause damage to the load, cause the load to be dropped, and/or cause injury to adjacent personnel.

There are many designs of devices used in lifting objects well known in the art, however, considerable shortcomings remain.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
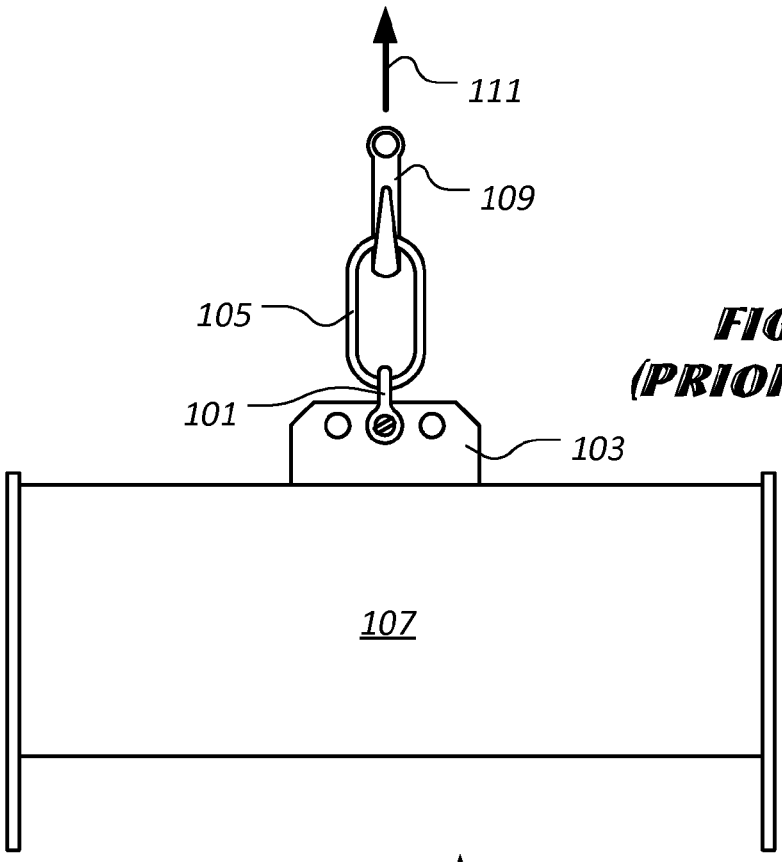
FIG. 1 (PRIOR ART)
FIGS. 1 and 2 are side, elevational views illustrating particular uses of a conventional shackle and lifting ring.
Figure 2:
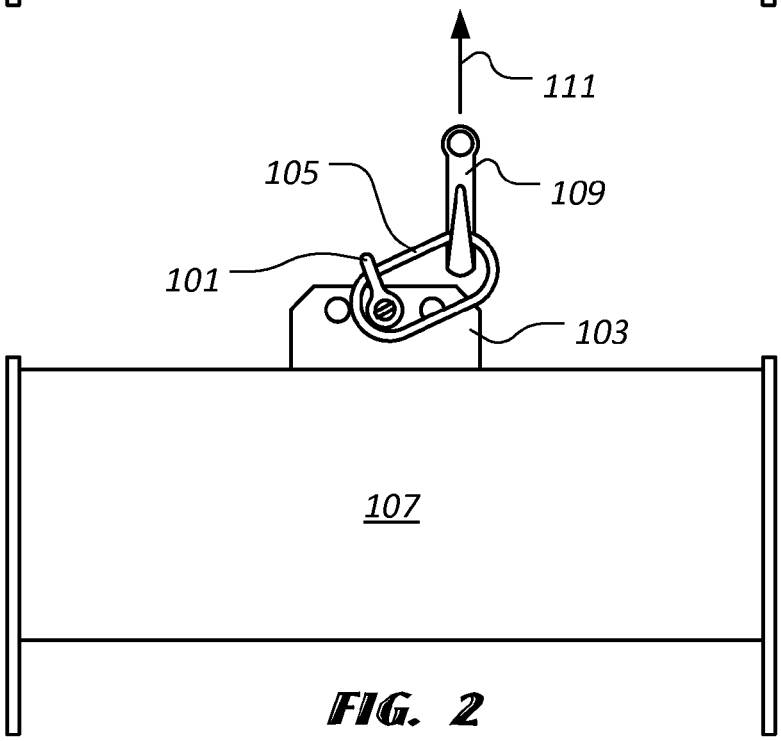
FIG. 2 (PRIOR ART)

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents a lifting ring assembly for use in material handling operations, such as in the lifting of objects. The lifting ring assembly includes a a shackle plate, a shackle operably associated with the shackle plate, a lifting ring operably associated with the shackle, and a biasing member operably associated with the shackle plate and the lifting ring for biasing the lifting ring away from the shackle plate. Preferably, the biasing member biases the lifting ring to a generally vertical or upright position. The shackle plate defines an opening therethrough through which a pin of the shackle is disposed. The shackle is interlinked with the lifting ring. The biasing member extends between the shackle plate and the lifting ring to bias the lifting ring away from the shackle plate and, preferably, to bias the lifting ring to a generally vertical or upright position. In one embodiment, the biasing member is a helical, compression spring. In certain embodiments, one or more elements are affixed to the shackle plate and/or the lifting ring to retain the biasing member in position.

Figure 3:
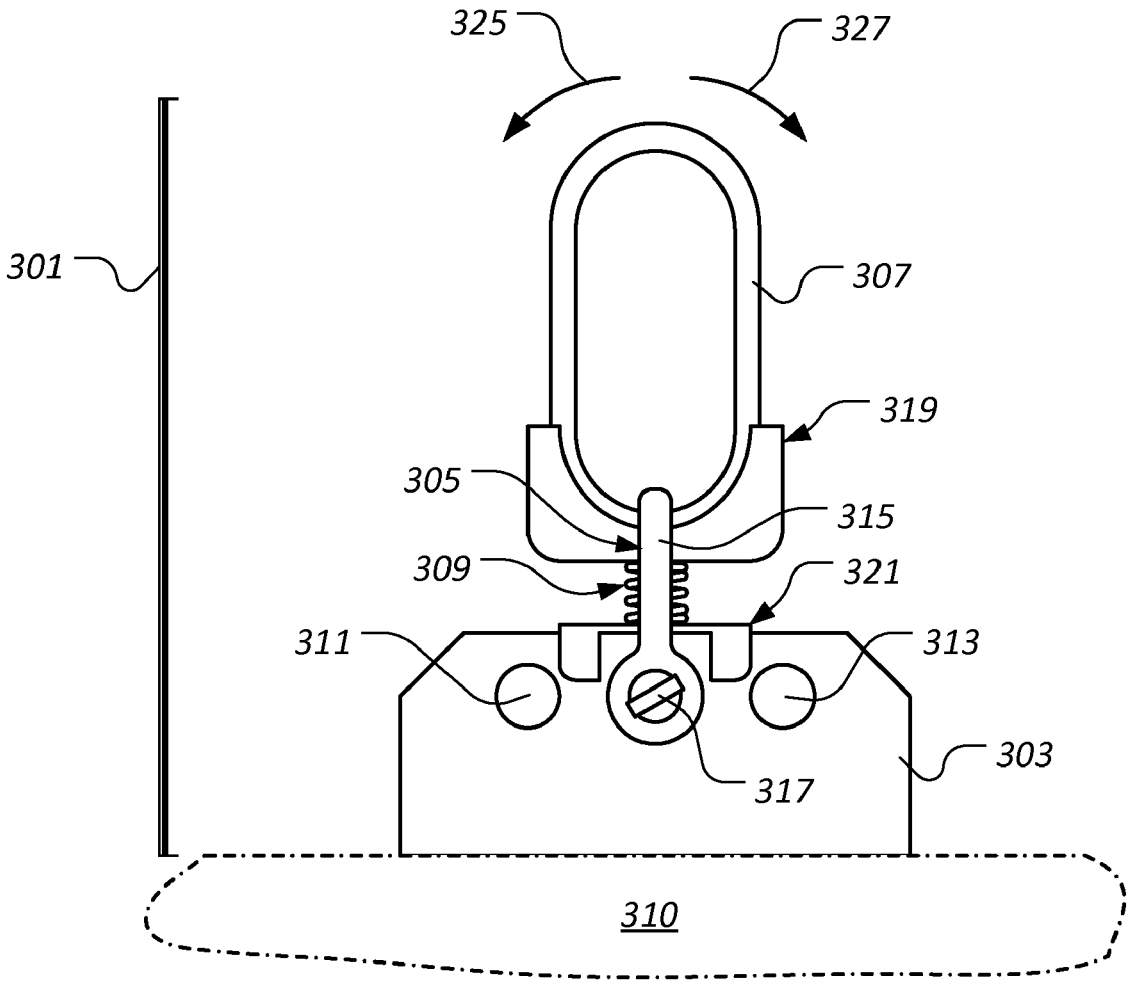
FIG. 3 is a side, elevational view of an illustrative embodiment of a lifting ring assembly.
Figure 4:
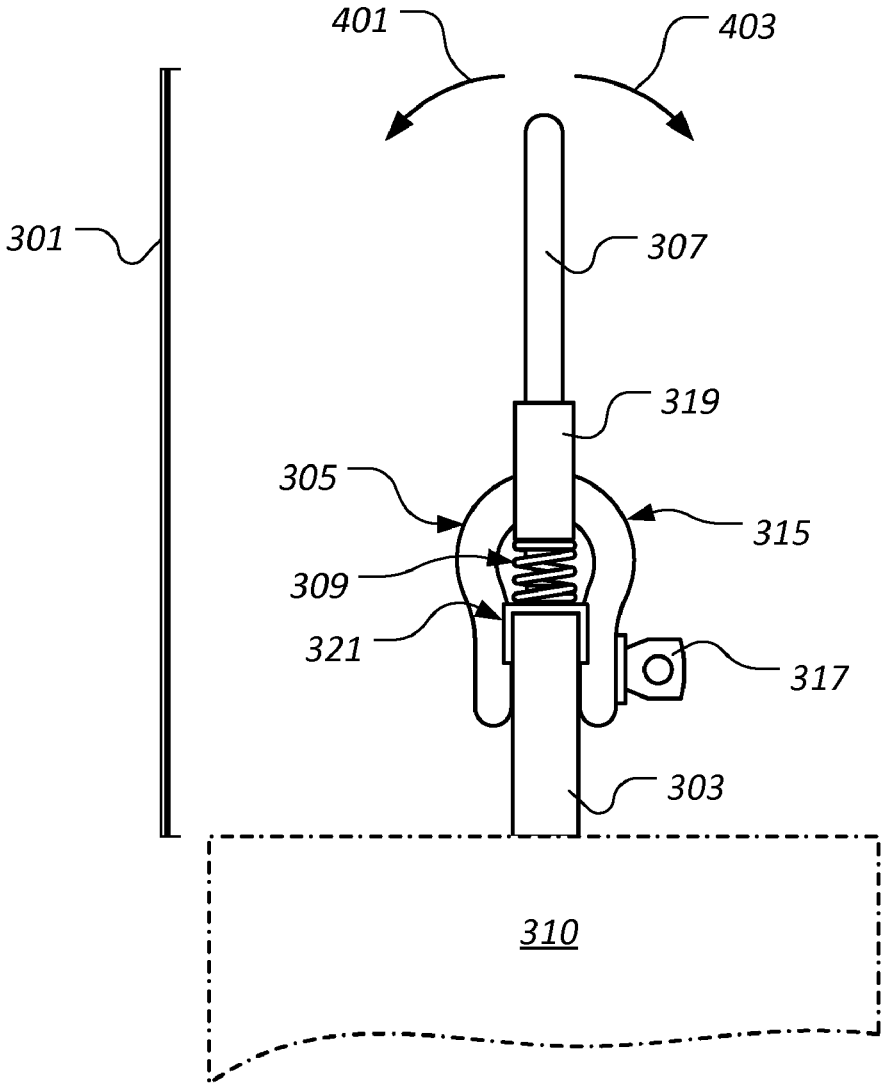
FIG. 4 is an end, elevational view of the illustrative embodiment of the lifting ring assembly of FIG. 3.
Figure 5:
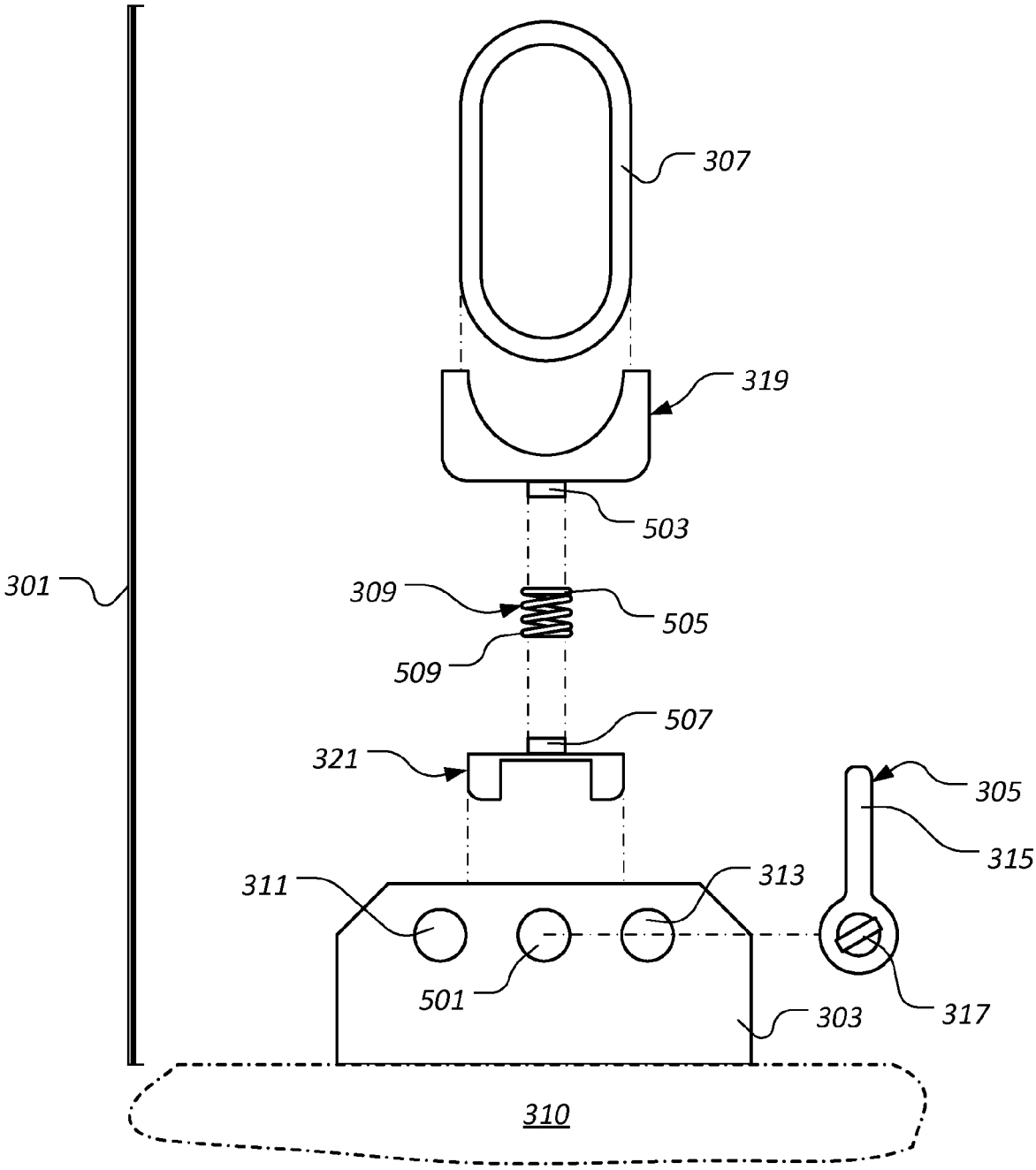
FIG. 5 is an exploded, side, elevational view of the illustrative embodiment of the lifting ring assembly of FIG. 3.

As shown in FIGS. 3-5, a lifting ring assembly 301 comprises a shackle plate 303, a shackle 305 operably associated with shackle plate 303, a lifting ring 307 operably associated with shackle 305, and a biasing element 309 operably associated with shackle plate 303 and lifting ring 307 for biasing lifting ring 307 away from shackle plate 303. Shackle plate 303 is shown attached to a structure 310, shown in phantom. Shackle plate 303 defines at least one opening, such as openings 311, 313 (each shown in FIGS. 3 and 5), and 501 (shown in FIG. 5). Shackle 305 includes an eye 315 and a pin 317 that is engaged with eye 315 to close eye 315. In the illustrated embodiment, pin 317 is disposed through opening 501 and engaged with eye 315 to couple shackle 305 with shackle plate 303. Eye 315 of shackle 305 is interlinked with lifting ring 307.

In the illustrated embodiment, lifting ring assembly 301 further comprises a lifting ring fitting 319 and a shackle plate fitting 321. Lifting ring fitting 319 is affixed, either generally permanently or removably, to lifting ring 307. Shackle plate fitting 321 is affixed, either generally permanently or removably, to shackle plate 321. As best shown in FIG. 5, lifting ring fitting 319 includes a boss 503 over which a first end 505 of biasing element 309 is disposed. Similarly, shackle plate fitting 321 includes a boss 507 over which a second end 509 of biasing element 309 is disposed. Biasing element 309 is compressed, i.e., is not in its relaxed state, between lifting ring fitting 319 and shackle plate fitting 321. Thus, bosses 503 and 507 retain biasing element in place. Moreover, biasing element 309 urges lifting ring 307 toward a side of eye 315 of shackle 305 away from pin 317 of shackle 305. As shown in FIG. 3, for example, if lifting ring 307 is moved by an external force in a direction corresponding to an arrow 325, biasing element 309 urges lifting ring 307 in a direction counter to arrow 325, e.g., corresponding to an arrow 327. As shown in FIG. 4, for example, if lifting ring 307 is moved by an external force in a direction corresponding to an arrow 401, biasing element 309 urges lifting ring 307 in a direction counter to arrow 401, e.g., corresponding to an arrow 403.

Returning to FIGS. 3-5, one or both of lifting ring fitting 319 and shackle plate fitting 321 comprise an elastomeric material, such as rubber, in certain embodiments. In such embodiments, lifting ring fitting 319 and shackle plate fitting 321 act to dampen vibrations and shocks transmitted by biasing element 309.

While the embodiments discussed and depicted herein include lifting ring fitting 319 and shackle plate fitting 321, the scope of the present invention is not so limited. Rather, the present invention contemplates configurations wherein a biasing element, such as biasing element 309, is directly interfaced with shackle plate 303 and lifting ring 309. Moreover, biasing element 309 may be retained in place by features of shackle plate 303 and lifting ring 309. It should also be noted that the scope of the present invention encompasses embodiments having component configurations that differ from the configurations described and depicted herein.

The lifting ring assembly of the present invention provides significant advantages, including (1) inhibiting kinking or other such binding of lifting rings; and (2) avoiding lifting rings becoming abruptly unkinked during lifting, thus avoiding damage to loads being lifted and injury to adjacent personnel.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A lifting ring assembly, comprising:
a shackle plate;
a shackle operably associated with the shackle plate;
a lifting ring operably associated with the shackle; and
a biasing element operably associated with the shackle plate and the lifting ring for biasing the lifting ring away from the shackle plate.

2. The lifting ring assembly of claim 1:
wherein the shackle comprises:
an eye and a pin for closing the eye; and
wherein the shackle plate defines an opening through which the pin is disposed.

3. The lifting ring assembly of claim 1, wherein the lifting ring is interlinked with the shackle.

4. The lifting ring assembly of claim 1, wherein the biasing element is a helical compression spring.

5. The lifting ring assembly of claim 1, further comprising:
a lifting ring fitting affixed to the lifting ring, the lifting ring fitting including a boss engaged with a first end of the biasing element.

6. The lifting ring assembly of claim 5, further comprising:
a shackle plate fitting affixed to the shackle plate, the shackle plate fitting including a boss engaged with a second end of the biasing element.

7. The lifting ring assembly of claim 6, wherein at least one of the lifting ring fitting and the shackle plate fitting comprise:
an elastomeric material.

8. The lifting ring assembly of claim 1, further comprising:
a shackle plate fitting affixed to the shackle plate, the shackle plate fitting including a boss engaged with a second end of the biasing element.

9. The lifting ring assembly of claim 1, wherein the biasing element biases the lifting ring toward a generally upright position.

10. A lifting ring assembly, comprising:
a shackle plate defining an opening;
a shackle operably associated with the shackle plate the shackle comprising:
an eye and a pin for closing the eye, the pin being disposed through the opening defined by the shackle plate;
a lifting ring operably associated with the shackle;
a spring operably associated with the shackle plate and the lifting ring for biasing the lifting ring away from the shackle plate;
a lifting ring fitting affixed to the lifting ring, the lifting ring fitting including a boss engaged with a first end of the spring; and
a shackle plate fitting affixed to the shackle plate, the shackle plate fitting including a boss engaged with a second end of the spring.

11. The lifting ring assembly of claim 10, wherein at least one of the lifting ring fitting and the shackle plate fitting comprise:
an elastomeric material.

12. The lifting ring assembly of claim 10, wherein the spring biases the lifting ring toward a generally upright position.

* * * * *